US009676025B2

(12) United States Patent
Tsutsumi et al.

(10) Patent No.: US 9,676,025 B2
(45) Date of Patent: Jun. 13, 2017

(54) LOW-PRESSURE CASTING APPARATUS AND LOW-PRESSURE CASTING METHOD USING THE SAME

(71) Applicant: HONDA MOTOR CO., LTD., Tokyo (JP)

(72) Inventors: Nobutaka Tsutsumi, Tochigi (JP); Tatsuya Miyazawa, Tochigi (JP); Hiroshi Takahashi, Tochigi (JP); Shinsuke Fujiyama, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/008,908

(22) Filed: Jan. 28, 2016

(65) Prior Publication Data

US 2016/0221075 A1 Aug. 4, 2016

(30) Foreign Application Priority Data

Feb. 2, 2015 (JP) ..... 2015-018767

(51) Int. Cl.
*B22D 18/04* (2006.01)
*B22D 18/08* (2006.01)
*B22D 17/14* (2006.01)

(52) U.S. Cl.
CPC ..... *B22D 18/04* (2013.01); *B22D 17/145* (2013.01); *B22D 18/08* (2013.01)

(58) Field of Classification Search
CPC ..... B22D 18/04; B22D 18/08
USPC ..... 164/119, 306, 309
See application file for complete search history.

(56) References Cited

U.S. PATENT DOCUMENTS 6,840,301 B2 * 1/2005 Nichol ..... B22D 18/04 164/119

FOREIGN PATENT DOCUMENTS

| | | | |
|---|---|---|---|
| JP | 60257961 A | * | 12/1985 |
| JP | 01-089851 | | 6/1989 |
| JP | 4-118255 | | 10/1992 |

OTHER PUBLICATIONS

Canadian Office Action dated Feb. 24, 2017, 4 pages.

* cited by examiner

*Primary Examiner* — Kevin E Yoon
(74) *Attorney, Agent, or Firm* — Rankin, Hill & Clark LLP

(57) ABSTRACT

Provided is a low-pressure casting apparatus for stable casting without using feedback control even if a furnace body has a crack, and a low-pressure casting method using the same. A low-pressure casting apparatus fills a cavity with molten metal M through a guiding unit by introducing gas into a holding furnace for heating the molten metal M to apply pressure to a surface of the molten metal M. The holding furnace includes a casing, a furnace body accommodated in the casing, and a refractory layer disposed between the casing and the furnace body, the refractory layer having a pore structure. The low-pressure casting apparatus further includes a first gas supply unit for supplying to the furnace body the gas to apply pressure to the molten metal M and a second gas supply unit for supplying gas to the refractory layer.

6 Claims, 3 Drawing Sheets

LOW-PRESSURE CASTING APPARATUS AND LOW-PRESSURE CASTING METHOD USING THE SAME

BACKGROUND OF THE INVENTION

Field of the Invention

The present invention relates to a low-pressure casting apparatus and a low-pressure casting method using the same.

Description of the Related Art

A low-pressure casting apparatus for low-pressure casting has been known that is provided with a casting die and a holding furnace provided below the casting die for heating and holding molten metal (refer to Japanese Utility Model Laid-Open No. 1-89851, for example).

The casting die is provided inside with a cavity shaped to conform to the outer shape of a casting and a gate in communication with the cavity. The gate is connected to a stoke through a gate sleeve. A lower portion of the stoke is inserted into the molten metal heated and held inside the holding furnace.

In the low-pressure casting apparatus, the holding furnace includes a metal casing, a furnace body accommodated in the metal casing, and a refractory layer provided between the metal casing and the furnace body. The refractory layer is formed from a porous material with a pore structure, for example, and prevents dissipation of heat of the molten metal to the outside while keeping the molten metal at a predetermined temperature as it is used as a heat insulating material.

According to the low-pressure casting apparatus, a relatively low pressure gas such as compressed air is supplied into the holding furnace to apply pressure to the surface of the molten metal, so that the molten metal is pressed into the cavity through the stoke, the gate sleeve, and the gate. The molten metal inside the cavity is cooled down and solidified while being maintained in a pressurized state by the gas such as compressed air to thereby obtaining a casting.

In the low-pressure casting apparatus, when supplying the gas such as compressed air into the holding furnace, a volume of the space in the furnace body not occupied by the molten metal is estimated in advance with a casting model to estimate a molten metal surface height level to be obtained by pressure applied to the space. If the furnace body has a crack due to deterioration over time, however, the gas such as compressed air supplied into the holding furnace partially leaks through the crack to the refractory layer to make the pressure increase in the space slower than that of the casting model, thereby failing to obtain a necessary molten metal surface height level.

In order to solve the problem, feedback control of detecting the pressure for each shot and changing the gas supply amount can be considered in the low-pressure casting apparatus.

In the low-pressure casting apparatus, however, the actual pressure increase delays relative to the instructed gas pressure in the feedback control because compressive gas such as air is used to apply pressure to the molten metal, which is an inertial liquid. As a result, the delay is reflected in the feedback control, and then, an over shoot occurs where the actual pressure becomes higher than the instructed pressure in the following shot. This makes the molten metal surface wavy due to pressure fluctuation, leading to inconvenience such as casting failure.

SUMMARY OF THE INVENTION

The present invention aims to provide a low-pressure casting apparatus that eliminates the inconvenience and allows stable casting without using the feedback control even if the furnace body has a crack.

Also, the present invention aims to provide a low-pressure casting method using the low-pressure casting apparatus.

In order to achieve the object, the low-pressure casting apparatus of the present invention is provided with a casting die having inside a cavity shaped to conform to an outer shape of a casting, a holding furnace provided below the casting die for heating and holding molten metal, and a guiding unit which guides the molten metal inside the holding furnace into the cavity, the low-pressure casting apparatus filling the cavity with the molten metal through the guiding unit by introducing gas into the holding furnace to apply pressure to a surface of the molten metal, and in the low-pressure casting apparatus, the holding furnace includes a metal casing, a furnace body accommodated in the metal casing, and a refractory layer disposed between the metal casing and the furnace body, the refractory layer having a pore structure, and the low-pressure casting apparatus is provided with a first gas supply unit for supplying to the furnace body the gas which applies pressure to the molten metal and a second gas supply unit for supplying gas to the refractory layer.

In the low-pressure casting apparatus of the present invention, because the gas supplied from the second gas supply unit fills the pore structure of the refractory layer, the gas supplied from the first gas supply unit only acts to apply pressure to the molten metal in the furnace body even if the furnace body has a crack. Accordingly, the low-pressure casting apparatus of the present invention reliably provides a predetermine pressure when applying pressure to the molten metal with the gas supplied from the first gas supply unit, and allows stable casting without using feedback control.

The low-pressure casting apparatus of the present invention preferably is provided with a plurality of the second gas supply units. This enhances the filling rate of the gas from the plurality of second gas supply units into the pore structure of the refractory layer to shorten the cycle time of the casting and allows the refractory layer to be filled with the air evenly throughout the entire refractory layer.

In the low-pressure casting apparatus of the present invention, the first gas supply unit and the second gas supply unit may each be provided with an independent gas supply source or may be provided with a common gas supply source.

By the way, in the casting apparatus of the present invention, the gas supply units may each be provided with a gas supply passage for supplying gas and an electromagnetic valve for opening and closing the gas supply passage, and further, the casting apparatus of the present invention may be provided with a control device for controlling opening and dosing of the electromagnetic valves.

Opening degree of the electromagnetic valve increases when an applied voltage is increased, thereby increasing the amount of the gas supplied by the gas supply unit. In order to easily control the gas supply amount, however, it is desirable that the gas supply amount is proportional to the applied voltage when the valve is opened by gradually increasing the applied voltage.

Depending on the characteristics of the electromagnetic valves, however, when the valve is opened by gradually increasing the applied voltage, the gas supply amount changes a little relative to changes in the applied voltage until the applied voltage reaches a first predetermined value. Also, while the gas supply amount is proportional to the applied voltage after the applied voltage exceeds the first predetermined value until it reaches a second predetermined value, the gas supply amount changes a little relative to changes in the applied voltage after the applied voltage exceeds the second predetermined value until it reaches a third predetermined value to fully open the valve. That is, in the electromagnetic valve, the gas supply amount cannot be made proportional to the applied voltage just by gradually increasing the applied voltage.

Then, it is conceivable to correct the applied voltage such that the gas supply amount is made proportional to the applied voltage.

That is, it is preferable in the casting apparatus of the present invention that the first gas supply unit is provided with a first gas supply passage for supplying the gas to the furnace body and a first electromagnetic valve opening and closing the first gas supply passage, the second gas supply unit is provided with a second gas supply passage for supplying the gas to the refractory layer and a second electromagnetic valve opening and dosing the second gas supply passage, and further, the low-pressure casting apparatus is provided with a control device controlling opening of each of the electromagnetic valves with a corrected applied voltage in which a correction value is added to an applied voltage so that an amount of the air supplied by each of the gas supply units is proportional to the applied voltage when each of the electromagnetic valves are opened by gradually increasing voltages to be applied to the respective electromagnetic valves.

According to the configuration, because each of the electromagnetic valves is opened with the corrected applied voltage calculated by adding the correction value to the applied voltage, the amount of the gas supplied by each of the gas supply units can be made proportional to the applied voltage. As a result, the supply amount of the gas can be controlled easily.

The low-pressure casting method of the present invention uses the low-pressure casting apparatus, and in the method, the cavity is filled with the molten metal through the guiding unit by supplying gas into the holding furnace through the first gas supply unit to apply pressure to a surface of the molten metal. The low-pressure casting method includes a step of detecting that a pressure inside the refractory layer is at atmospheric pressure; a step of supplying the gas to the refractory layer through the second gas supply unit and supplying the gas to the furnace body through the first gas supply unit as long as the pressure inside the refractory layer is detected to be at atmospheric pressure; a step of filling the cavity with the molten metal through the guiding unit by applying pressure to the surface of the molten metal as long as the pressure inside the refractory layer is detected to be equal to a pressure inside the furnace body; a step of stopping the supply of the gas by the first gas supply unit and the second gas supply unit when it is detected that the pressure inside the refractory layer and the pressure inside the furnace body have reached a predetermined pressure and to keep the surface of the molten metal in a pressurized state; and a step of releasing the pressure in the furnace body after the molten metal filled in the cavity cools down, and taking the casting out of the cavity.

BRIEF DESCRIPTION OF THE DRAWINGS

FIGS. 3A-3C are schematic cross-sectional views showing another aspect of each gas supply unit of the low-pressure casting apparatus in FIG. 1 in which FIG. 3A shows a low-pressure casting apparatus provided with two second gas supply passages, FIG. 3B shows a low-pressure casting apparatus where a first gas supply passage and a second gas supply passage use a common gas cylinder, and FIG. 3C shows a low-pressure casting apparatus where a first gas supply passage and two second gas supply passages use a common gas cylinder.

DETAILED DESCRIPTION OF THE PREFERRED EMBODIMENTS

Next, an embodiment of the present invention will be described further in detail with reference to the attached drawings.

Figure 1:
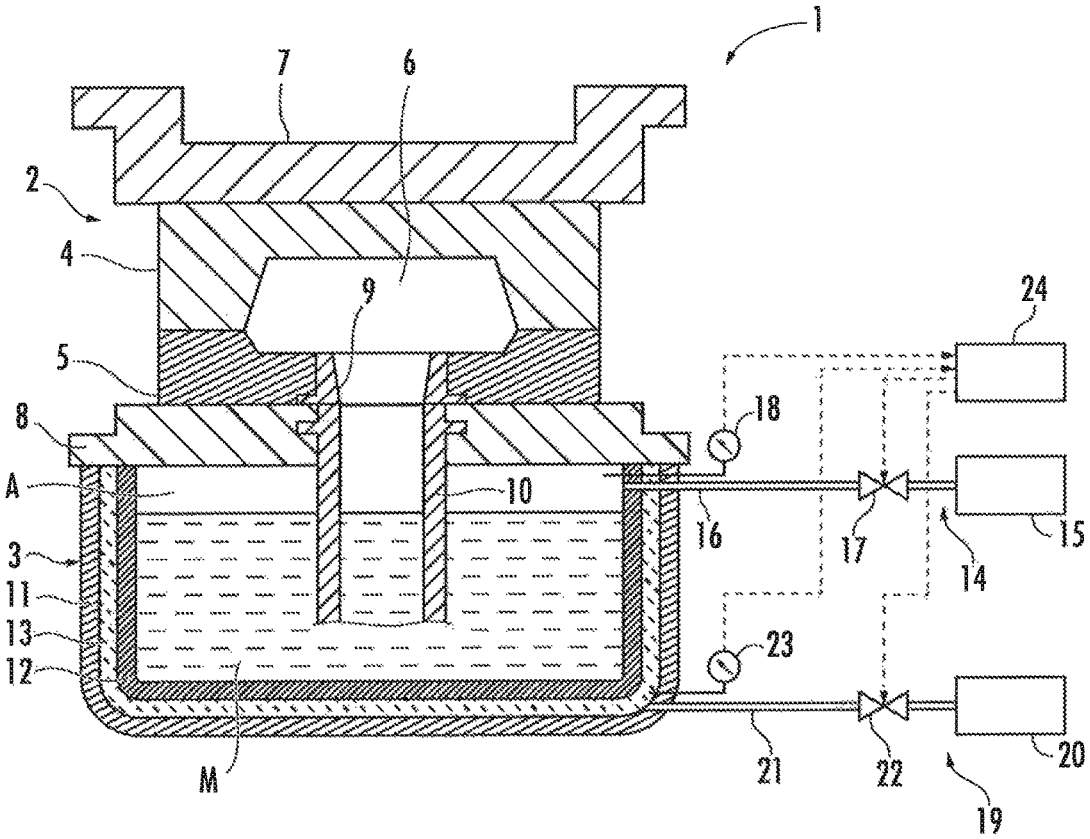
FIG. 1 is a schematic cross-sectional view showing a configuration example of a low-pressure casting apparatus of the present invention.

As shown in FIG. 1, a low-pressure casting apparatus 1 of the embodiment is used for low-pressure casting of a cylinder head of an internal-combustion engine, for example, and provided with a casting die 2 and a holding furnace 3 provided below the casting die 2 and heating and holding molten metal M such as aluminum.

The casting die 2 includes an upper mold 4 and a lower mold 5, and has a cavity 6 between the upper mold 4 and the lower mold 5 that has a shape conforming to the outer shape of the cylinder head as a casting. Here, the upper mold 4 is mounted to a movable die base 7 and can be freely moved up and down by an actuator or the like (not shown), while the lower mold 5 is fixed to a die base 8 that covers an upper opening of the holding furnace 3.

The lower mold 5 is provided with a gate 9 in communication with the cavity 6. A lower end portion of the gate 9 is in communication with a stoke 10 vertically penetrating the die base 8 and protruding downward. A lower portion of the stoke 10 is inserted into the molten metal M heated and held by the holding furnace 3. The stoke 10 acts as a guiding unit that guides the molten metal M inside the holding furnace 3 into the cavity 6.

The holding furnace 3 includes a casing 11 formed from an ordinary steel such as iron or steel (e.g., SS400), a furnace body 12 accommodated in the casing 11 and formed from a refractory castable, for example, and a refractory layer 13 placed between the casing 11 and the furnace body 12 and having a pore structure formed from a ceramic fiber, for example.

The holding furnace 3 is provided, at its peripheral wall surface and higher than the surface level of the molten metal M inside the furnace body 12, with a first gas supply unit 14 supplying gas to the inside of the furnace body 12 to apply pressure to the molten metal M and a first pressure gauge 18 detecting a pressure inside the furnace body 12. The gas for applying pressure to the molten metal M may be, for example, compressed air.

The first gas supply unit 14 is provided with an air pump as a first gas supply source 15, a first gas supply passage 16 connecting at one end to the first gas supply source 15 and at the other end to the furnace body 12 at a higher position than the surface level of the molten metal M, and a first electromagnetic valve 17 opening and closing the first gas supply passage 16.

The holding furnace 3 is provided, at the bottom portion of the peripheral wall portion, with a second gas supply unit 19 supplying compressed air to the refractory layer 13 to fill the pore structure with air, and a second pressure gauge 23 detecting a pressure inside the refractory layer 13.

The second gas supply unit 19 is provided with a second gas supply source 20 such as an air pump, a second gas supply passage 21 connecting at one end to a second gas supply source 20 and at the other end to the bottom portion of the refractory layer 13, and a second electromagnetic valve 22 opening and closing the second gas supply passage 21.

The electromagnetic valves 17 and 22 and the pressure gauges 18 and 23 are each connected to a control device 24. The control device 24 controls the opening and closing of the electromagnetic valves 17 and 22 depending on pressures detected by the pressure gauges 18 and 23, respectively. The control device 24 opens each of the electromagnetic valves 17 and 22 with a corrected applied voltage calculated by adding a correction value to an applied voltage operated by an operator such that the amount of compressed air supplied through each of the gas supply passages 16 and 21 is proportional to the applied voltage.

Figure 2:
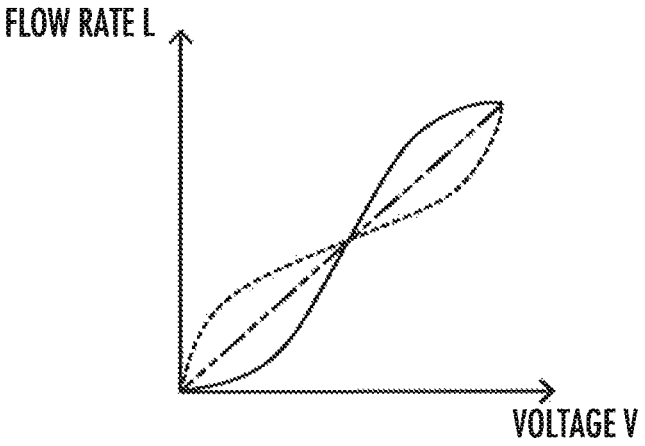
FIG. 2 is a view explaining a method for correcting an applied voltage.

Depending on the characteristics of the electromagnetic valves 17 and 22, the relation between an applied voltage operated by the operator and a compressed air supply amount varies such that the supply amount changes a little when the applied voltage is small and the electromagnetic valves 17 and 22 start to open from the closed state, changes greatly as the applied voltage increases, and changes a little when the applied voltage further increases and the electromagnetic valves 17 and 22 are almost fully-opened, for example, as shown by a solid curve line in FIG. 2.

Thus, in order to achieve output characteristics as shown by the curved dashed line in the figure, the control device 24 opens the electromagnetic valves 17 and 22 with the corrected applied voltages calculated by adding correction values to the applied voltages. Accordingly, the amount of actually supplied compressed air relative to the applied voltage is as shown by a two-dot straight line in the figure, making the amount of actually supplied compressed air proportional to the applied voltage. As a result, the supply amount can be controlled easily.

Next, a description will be given to a casting method by the low-pressure casting apparatus 1 of the embodiment.

First, the control device 24 opens the second electromagnetic valve 22, and keeps supplying the compressed air to the bottom portion of the refractory layer 13 with the second gas supply unit 19 as long as the second pressure gauge 23 keeps detecting the atmospheric pressure.

The compressed air supplied to the bottom portion of the refractory layer 13 diffuses laterally through the pore structure of the refractory layer 13, and also, diffuses upwardly as it is heated by the molten metal M inside the furnace body 12, thereby filling the entire pore structure of the refractory layer 13. Then, the pressure of a space A inside the furnace body 12, higher than the surface level of the molten metal M (hereinafter, referred to as a pressurized space) is equalized with the pressure in the refractory layer 13.

Next, the control device 24 further opens the second electromagnetic valve 22 to supply compressed air to the refractory layer 13 with the second gas supply unit 19, while opening the first electromagnetic valve 17 to supply compressed air to the pressurized space A with the first gas supply unit 14.

When the pressure in the pressurized space A increases as the pressurized space A is supplied with the compressed air by the first gas supply unit 14, the liquid surface of the molten metal M is applied with pressure, and the molten metal M rises inside the stoke 10 to be forced into the cavity 6 through the gate 9.

Subsequently, when the both pressures detected by the pressure gauges 18 and 23 reach a predetermined pressure, the control device 24 closes the electromagnetic valves 17 and 22 to thereby keep the pressurized state by the gas supply units 14 and 19. At this time, because the refractory layer 13 is maintained at the predetermined pressure equal with that inside the pressurized space A as the pore structure thereof is filed with the compressed air, the compressed air supplied from the first gas supply unit 14 only acts to apply pressure to the molten metal M in the furnace body 12 to reliably keep the pressurized space A at the predetermined pressure even if the furnace body 12 has a crack.

Then, the molten metal M inside the cavity 6 is cooled down and solidified while maintaining the pressurized state in the pressurized space A by the compressed air to provide the cylinder head as a casting.

When the pressurization is released by discharging the compressed air in the pressurized space A through vent lines (not shown) after the molten metal M inside the cavity 6 solidifies, the molten metal M in the gate 9 remaining unsolidified is returned to the holding furnace 3 through the stoke 10. The casting is taken out by moving the upper mold 4 upwardly to open the casting die 2.

At this time, it is preferable that the refractory layer 13 is not provided with any discharging units such as vent lines, but only the compressed air inside the pressurized space A be discharged. With this configuration, it is possible to determine that the furnace body 12 has a crack if the pressure detected by the second pressure gauge 23 decreases after discharging the compressed air inside the pressurized space A.

Figure 3A:
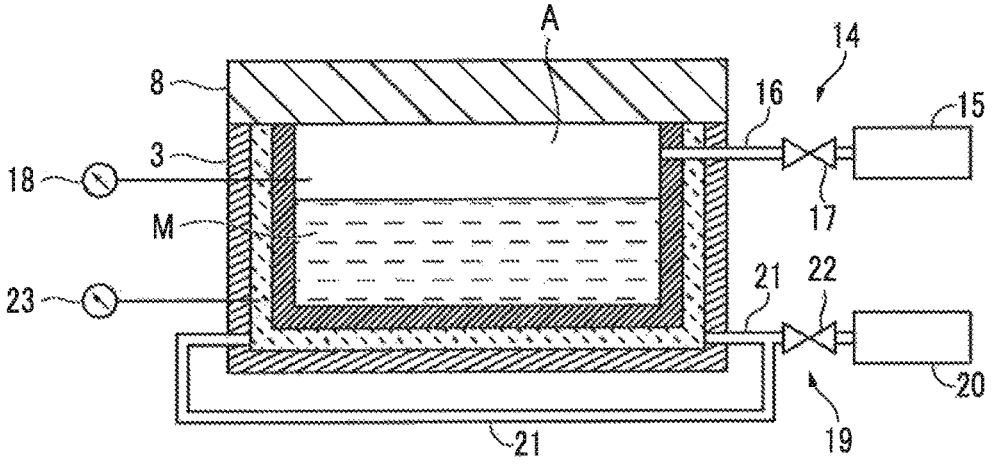
Figure 3B:
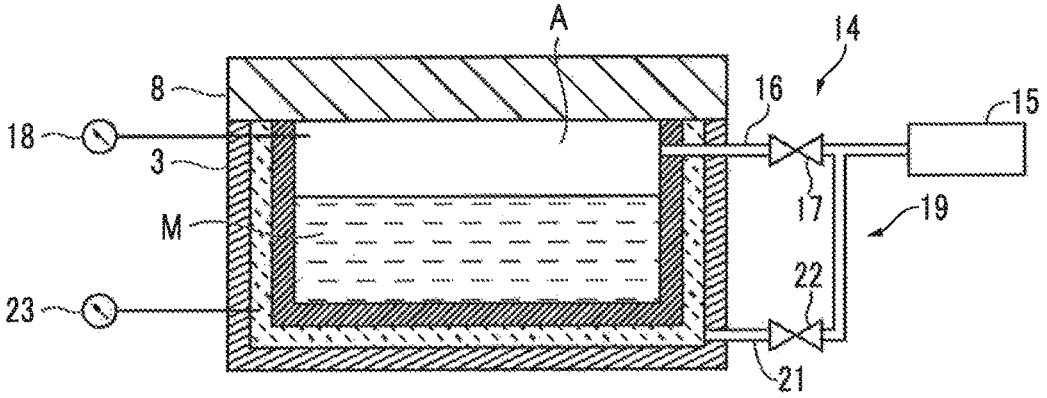
Figure 3C:
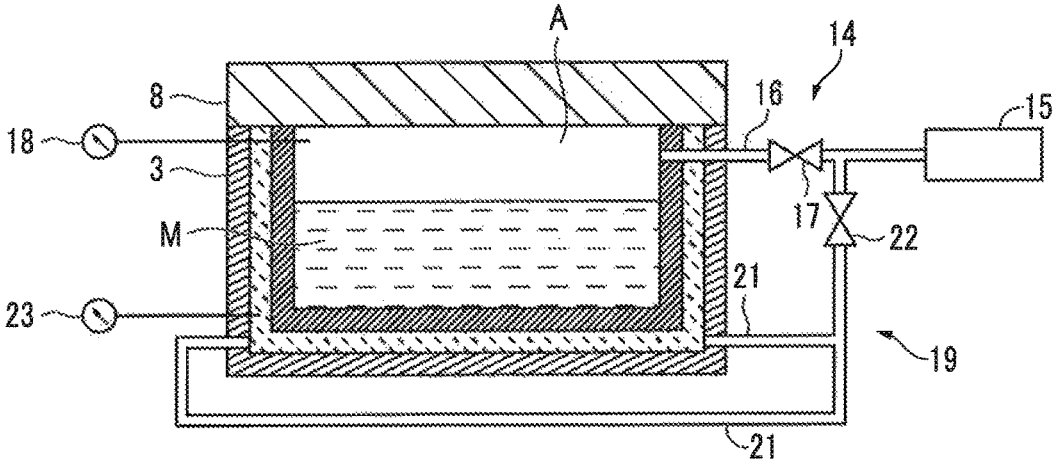

Next, another aspect of the first and second gas supply units 14 and 19 will be described with reference to FIGS. 3A-3C. FIGS. 3A-3C are schematic views illustrating the holding furnace 3, and the gas supply units 14 and 19 of FIG. 1 in a simplified way while omitting the other configurations.

As shown in FIG. 3A, the second gas supply unit 19 may be configured such that the second gas supply passage 21 branches at the downstream side into two or more ways, which are then connected to a plurality of points of the bottom portion of the refractory layer 13. The compressed air is supplied to the plurality of points of the refractory layer 13 with the second gas supply unit 19, that is branched into two or more ways, and thus this enhances the filling rate of the gas into the pore structure of the refractory layer to shorten the cycle time of the casting and allows the refractory layer 13 to be filled with the compressed air evenly throughout itself.

Alternatively, as shown in FIG. 3B, the second gas supply unit 19 may be configured to use one of the two branches at the downstream side of the first gas supply passage 16 as the second gas supply passage 21, and share the first gas supply source 15 with the first gas supply unit 14 to use the first gas supply source 15 as the second gas supply source. This allows the apparatus to be constructed with one gas supply source 15, thereby reducing the cost.

Further alternatively, as shown in FIG. 3C, the second gas supply unit 19 may be configured to use one of the two branches at the downstream side of the first gas supply passage 16 as the second gas supply passage 21, and additionally, the second gas supply passage 21 may branch at the downstream side into two or more ways, which are then connected to a plurality of points of the bottom portion of the refractory layer 13. This enhances the filling rate of the gas into the pore structure of the refractory layer to shorten the cycle time of the casting and allows the refractory layer 13 to be filled with the compressed air evenly throughout itself, and additionally, allows the apparatus to be constructed with one gas supply source 15, thereby reducing the cost.

What is claimed is:

1. A low-pressure casting apparatus comprising:

a casting die having inside a cavity shaped to conform to an outer shape of a casting;

a holding furnace provided below the casting die which heats and holds molten metal; and a guiding unit which guides the molten metal inside the holding furnace into the cavity, the low-pressure casting apparatus which fills the cavity with the molten metal through the guiding unit by introducing gas into the holding furnace to apply pressure to a surface of the molten metal, wherein the holding furnace includes a metal casing, a furnace body accommodated in the metal casing, and a refractory layer disposed between the metal casing and the furnace body, the refractory layer having a pore structure, and the low-pressure casting apparatus is provided with a first gas supply unit which supplies to the furnace body the gas to apply pressure to the molten metal and a second gas supply unit which supplies gas to the refractory layer.

2. The low-pressure casting apparatus according to claim 1, wherein the low-pressure casting apparatus is provided with a plurality of the second gas supply units.

3. The low-pressure casting apparatus according to claim 1, wherein the first gas supply unit and the second gas supply unit are each provided with an independent gas supply source.

4. The low-pressure casting apparatus according to claim 1, wherein the first gas supply unit and the second gas supply unit are provided with a common gas supply source.

5. The low-pressure casting apparatus according to claim 1, wherein the first gas supply unit is provided with a first gas supply passage for supplying gas to the furnace body and a first electromagnetic valve opening and closing the first gas supply passage, the second gas supply unit is provided with a second gas supply passage for supplying the gas to the refractory layer and a second electromagnetic valve opening and closing the second gas supply passage, and further, the low-pressure casting apparatus is provided with a control device controlling opening of each of the electromagnetic valves with a corrected applied voltage in which a correction value is added to an applied voltage so that an amount of the air supplied by each of the gas supply units is proportional to the applied voltage when each of the electromagnetic valves are opened by gradually increasing voltages applied to the respective electromagnetic valves.

6. A low-pressure casting method using a low-pressure casting apparatus, the low-pressure casting apparatus including:

a casting die having inside a cavity shaped to conform to an outer shape of a casting;

a holding furnace provided below the casting die for heating and holding molten metal; and a guiding unit guiding the molten metal inside the holding furnace into the cavity, the holding furnace having a metal casing, a furnace body accommodated in the metal casing, and a refractory layer disposed between the metal casing and the furnace body, the refractory layer having a pore structure, the low-pressure casting apparatus having a first gas supply unit for supplying to the furnace body gas to apply pressure to the molten metal and a second gas supply unit for supplying gas to the refractory layer, the cavity being filled with the molten metal through the guiding unit by supplying the gas into the holding furnace through the first gas supply unit to apply pressure to a surface of the molten metal, and the low-pressure casting method comprising:

a step of detecting that a pressure inside the refractory layer is at atmospheric pressure;

a step of supplying the gas to the refractory layer through the second gas supply unit and supplying the gas to the furnace body through the first gas supply unit as long as the pressure inside the refractory layer is detected to be at the atmospheric pressure;

a step of filling the cavity with the molten metal through the guiding unit by applying pressure to the surface of the molten metal as long as the pressure inside the refractory layer is detected to be equal to a pressure inside the furnace body;

a step of stopping the supply of the gas by the first gas supply unit and the second gas supply unit when it is detected that the pressure inside the refractory layer and the pressure inside the furnace body have reached a predetermined pressure to keep the surface of the molten metal in a pressurized state; and a step of releasing the pressure in the furnace body after the molten metal filled in the cavity cools down, and taking the casting out of the cavity.

* * * * *